US006808751B2

(12) United States Patent
Therkildsen

(10) Patent No.: US 6,808,751 B2
(45) Date of Patent: Oct. 26, 2004

(54) METHOD FOR IMPROVING CORROSION RESISTANCE OF CHROME PLATED MATERIAL

(75) Inventor: Charles G. Therkildsen, Barrington, IL (US)

(73) Assignee: Industrial Hard Chrome, Geneva, IL (US)

( * ) Notice: Subject to any disclaimer, the term of this patent is extended or adjusted under 35 U.S.C. 154(b) by 0 days.

(21) Appl. No.: 09/969,940

(22) Filed: Oct. 3, 2001

(65) Prior Publication Data

US 2003/0064157 A1 Apr. 3, 2003

(51) Int. Cl.[7] ..... B05D 3/12

(52) U.S. Cl. ..... 427/355; 427/318; 427/334; 427/359; 427/368; 427/375; 427/388.1; 427/388.4; 427/421; 427/429; 427/388.5

(58) Field of Search ..... 427/318, 334, 427/355, 359, 368, 375, 388.1, 388.4, 421, 388.5, 429

(56) References Cited

U.S. PATENT DOCUMENTS

| | | | | |
|---|---|---|---|---|
| 3,616,287 A | | 10/1971 | Draghicescu et al. | 204/25 |
| 3,625,039 A | | 12/1971 | Kubach et al. | 72/53 |
| 3,691,029 A | | 9/1972 | Raymond et al. | 204/37 R |
| 3,701,677 A | | 10/1972 | Miyata et al. | 204/35 R |
| 3,720,596 A | | 3/1973 | Dhaghicescu et al. | 204/211 |
| 3,751,344 A | | 8/1973 | Angelini | 204/28 |
| 3,843,495 A | | 10/1974 | Malak | 204/35 R |
| 3,844,760 A | | 10/1974 | Nelson | 71/67 |
| 3,847,760 A | | 11/1974 | Malak | 204/35 R |
| 3,852,170 A | | 12/1974 | Angelini | 204/28 |
| 3,977,839 A | | 8/1976 | Paislin, Jr. | 29/195 |
| 4,065,365 A | | 12/1977 | Ibarguengoitia | 204/25 |
| 4,111,763 A | | 9/1978 | Pryor | 204/38 A |
| 5,271,823 A | | 12/1993 | Schachameyer et al. | 205/224 |
| 5,306,531 A | * | 4/1994 | Laurence et al. | 427/569 |
| 5,480,536 A | * | 1/1996 | Suehiro et al. | 205/151 |
| 5,749,773 A | * | 5/1998 | Tabata | 451/66 |

* cited by examiner

*Primary Examiner*—Katherine A. Bareford
(74) *Attorney, Agent, or Firm*—Greenberg Traurig, LLP

(57) ABSTRACT

A method and apparatus for improving the corrosion resistance of chrome plated materials that provides for heating the chrome plated materials above the melting point of a buffing compound, and then buffing the heated materials with the buffing compound applied. An induction heater is used, before or after the buffing compound is applied. Computer controls, responsive to operator input of the cross-sectional size, composition and/or speed of movement of the chrome plated materials, to in turn regulate the power to an induction coil heater.

10 Claims, 1 Drawing Sheet

METHOD FOR IMPROVING CORROSION RESISTANCE OF CHROME PLATED MATERIAL

BACKGROUND OF THE INVENTION

1. Field of the Invention

The present invention is directed to finishing chrome plated materials, and in particular, to methods and apparatus for improving the corrosion resistance of chrome plated materials.

2. The Prior Art

Materials are chrome plated to reduce surface corrosion of the materials. Nevertheless, despite the chrome plating, surface corrosion still occurs and presents problems. This is particularly true in applications where there is intimate contact between the surface of the chrome plated materials and another material. Thus, for example, chrome plated rods used in hydraulic applications come into contact with seals made of rubber and similar materials. Surface corrosion of such rods has the additional disadvantage of causing accelerated wear of the seals. In use, such rods are subjected to high temperatures during operation of the equipment in which they are used, which increases the occurrence of corrosion.

In order to improve the corrosion resistance of chrome plated rods and the like, they are subjected in the prior art to a polishing process. A chrome plated rod is advanced along a line from an entrance end upon a series of pairs of offset rollers that both rotate and advance the rod from the entrance end to the exit end of the line Generally, after the rod is placed on the offset conveying rollers, the periphery of the chrome plated rod is initially subjected to wet abrasive polishing at one or more polishing stations. After such wet abrasive polishing, a buffing compound, of any of a selected one of a number of commercially available mixtures, is applied to the rotating chrome plated rod. Usually such buffing compounds are applied in a multi-phase mixture by spraying them onto the rotating and advancing rod.

The prior art process then subjects the rod, with the buffing compound applied, to a series of buffing steps at a number of buffing stations. Generally, three buffing stations are used in the prior art to provide the required amount of polishing or buffing to sufficiently drive the buffing compound into the micro cracks in the chrome plated surface. Thus, open micro cracks in the chrome plated surface are sealed against corrosion by the impregnated buffing compound.

In such prior art processes, as the compound treated chrome plated surface is subjected to more polishing or buffing, it results in a higher surface finish. Thus, in the prior art process of improving the corrosion resistance of chrome plated materials, there is a corollary between the degree of surface finish and the expected resultant corrosion resistance. However, particularly in hydraulic applications, there is a disadvantage to having too high of a surface finish as it impedes the effectiveness of the cooperating seals. Nevertheless, if the corrosion resistance of the chrome plated rods is not significantly improved by an application of a buffing compound, there will be a resulting increase in downtime of production of the hydraulic equipment while the corroded rods and/or the ruined seals need to be replaced.

Accordingly, it would be desirable to provide a method and apparatus for improving the corrosion resistance of chrome plated materials, in order to increase the life of such materials and to decrease the downtime of machines in which they are used.

These and other desirable characteristics of the present invention will become apparent in light of the present specification, including claims, and drawings.

SUMMARY OF THE INVENTION

The present invention is directed, in part, to an apparatus for improving the corrosion resistance of chrome plated materials. The apparatus comprises a line for receiving and processing chrome plated materials. The line has an entrance at one, entrance end, and an exit at another, exit end, opposed to the one entrance end. The apparatus further comprises a mechanism for moving the received chrome plated materials along the line from the one entrance end to the other exit end during processing, an applicator intermediate the one entrance end and the other exit end for applying a buffing compound, a heater for heating both the chrome plated materials and the buffing compounds, and at least one buffer for buffing the heated chrome plated materials and the buffing compound.

The heater may be positioned after the applicator and before the at least one buffer as the chrome plated materials move from the one entrance end to the other exit end.

The buffing compound has a melting point and the heater heats the chrome plated materials to a temperature above the melting point of the buffing compound. The heater heats the chrome plated material to approximately 160° F. In the preferred embodiment, the heater is an induction coil, though other forms of heat source are contemplated, such as conduction or convection heaters.

The apparatus further comprises a rotating buffer, though there may be a plurality of rotating buffers.

The applicator is a sprayer and the buffing compound is applied by spraying it onto the chrome plated materials.

The heater may be computer controlled in response to input of a size factor of the chrome plated materials.

The present invention is also directed, at least in part, to a method for improving the corrosion resistance of chrome plated materials comprising the steps of:

applying a buffing compound to the chrome plated materials;

heating the chrome plated materials;

buffing the heated chrome plated materials after the buffing compound has been applied.

In the method of the present invention, the step of applying the buffing compound may be accomplished by spraying it onto the chrome plated materials. Moreover, the step of heating chrome plated materials may be done after the step of applying the buffing compound.

In the method of the present invention, the buffing compound has a melting point and the chrome plated materials and the buffing compound are heating above the melting point of the buffing compound. Thus, the chrome plated materials may be heated to approximately 160° F. In such case, the buffing occurs before the chrome plated materials cool down below approximately 140° F.

For that embodiment in which the heating step is effected by an induction coil, controlling the heating of the chrome plated material may be accomplished by a computer responsive to input of one or more factors, such as speed of movement, size and composition of the chrome plated material.

The buffing step in the present invention may be accomplished by at least one rotating buffing wheel, or by a plurality of buffing wheels.

The method of the present invention may also comprise the step of advancing the chrome plated materials along a line from one entrance end to an opposed exit end, with the steps of applying the buffing compound, heating the chrome plated materials and buffing the heated chrome plated material with the buffing compound applied being accomplished at discrete intervals along the line from the one entrance end to the other exit end.

DETAILED DESCRIPTION OF THE DRAWINGS

Figure 1:
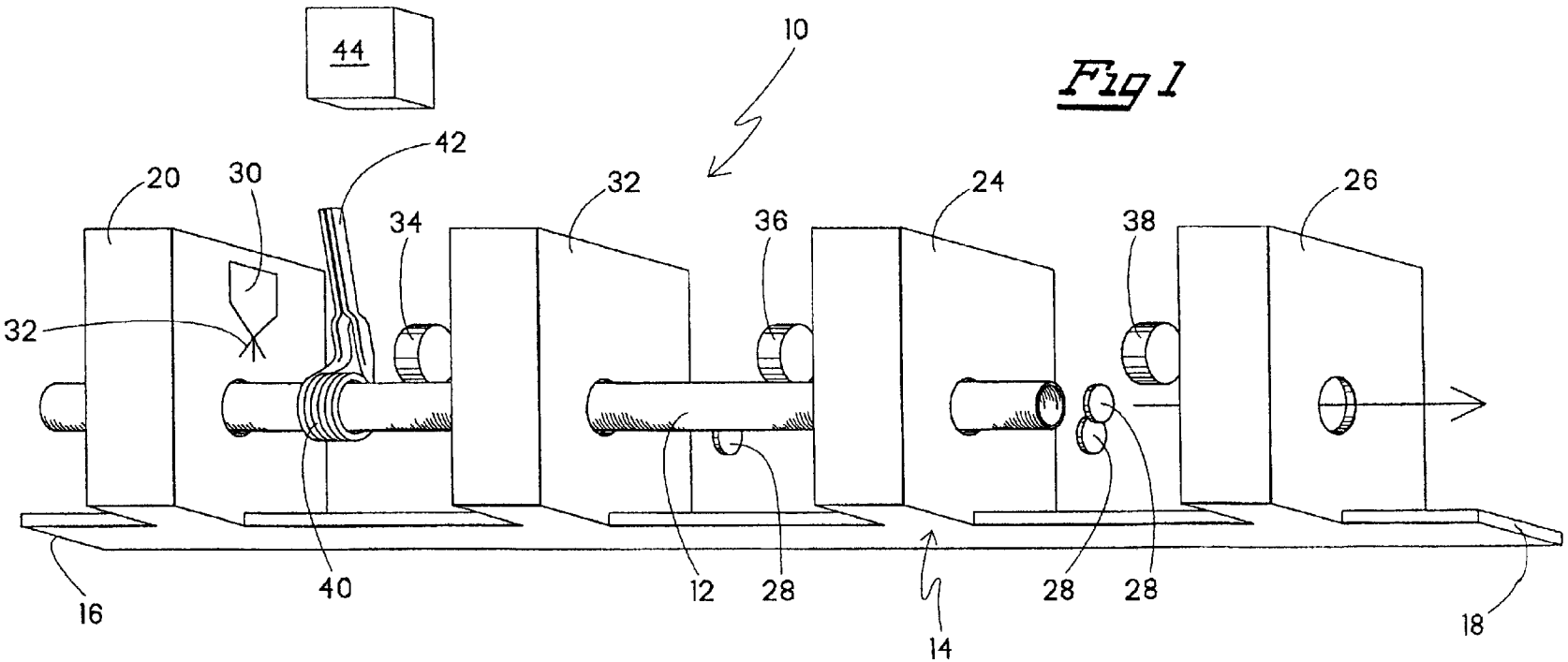
FIG. 1 is a perspective, schematic illustration of a portion of an apparatus according to the present invention, and which may be used for practicing the method of the present invention.

While this invention is susceptible of embodiment in many different forms, there is shown in the drawings and will be discussed herein in detail, a particular embodiment of the invention, with the understanding that the present disclosure is intended to be considered as an exemplification of the principles of the invention and is not intended to limit the invention to the embodiment illustrated.

FIG. 1 is a perspective, schematic illustration of part of an apparatus 10 for improving the corrosion resistance of chrome plated rods. More particularly, FIG. 1 illustrates that portion of a line 14 in which a chrome plated rod 12 has a buffing compound 32 applied by spraying onto the rod 12, which is being both advanced and rotated. For ease of illustration, portions of line 14, as they would generally exist in a commercial environment, have been omitted. Thus, it will be appreciated by those skilled in the art that, prior to what has been designated as the one entrance end 16, there will be another portion of the line which initially receives chrome plated rod 12 and advances it through a series of wet abrasive polishing stations. Such wet abrasive polishing stations are conventional in the prior art processes and accordingly are omitted from this illustration. Similarly, it will also be appreciated by those skilled in the art that, beyond what has been designated as the other exit end 18 in FIG. 1, there is another portion of the line upon which the chrome plated rod is received for cooling and inspection after being advanced through the portion of the line illustrated in FIG. 1.

Chrome plated rod 12 is placed upon a series of pairs of offset driven rollers 28, which both rotate rod 12 and advance it through line 14 from the one entrance end 16 through to the other exit end 18. Again, for ease of illustration, most of such rollers 28 have been omitted from FIG. 1. The number of rollers required, their structure, arrangement and driving mechanisms are known to those skilled in the art.

The embodiment of the apparatus, and the method practiced using the apparatus, as illustrated in FIG. 1, includes three stations, which are defined along line 14 by the four housing sections 20, 22, 24 and 26. These housing sections conveniently enclose portions of the conventional drive mechanisms (not shown) that are used in the prior art for the rotating, advancing and polishing of chrome plated rod 12.

After rod 12 is advanced through the wet polishing stations (not shown), it passes through housing section 20. Either within housing section 20, or as illustrated in FIG. 1, upon exit from housing station 20, an applicator 30 applies a buffing compound 32. The buffing compound may be selected from any of a number of commercially available buffing compounds, which have been used in the prior art processes. The buffing compound may be applied as a solid, or as illustrated in FIG. 1, as a liquid by a spray applicator. Although the buffing compound may be referred to as a liquid, it is more correctly a multi-phase mixture that includes solids in liquid media, if it is not a solid at time of application. Each of the buffing compounds, more specifically the solids of the buffing compounds, has a melting point. Mostly, such melting points are below 160° F.

In the present invention, as illustrated in FIG. 1, after the buffing compound is applied to the rod, both the rod and the buffing compound pass through an induction heating coil. As an alternative embodiment, the rod could pass through the induction heating coil 40, and the buffing compound 32 could then be applied. As a further embodiment, the heater need not be a coil, nor even be an induction heater. Conduction and/or convection heaters may be used to achieve a 160° F. temperature of the chrome plated material, although they may require a greater time and/or distance to properly heat the chrome plated material.

Induction coil 40 is connected through suitable conductors 42 to a power source (not shown). In addition, induction coil 40 is connected to a computer controller 44 which regulates the power to induction coil 40 for heating rod 12 to a temperature above the melting point of the buffing compound used. In a particular embodiment of the present invention, a temperature of 160° F. has been used to melt buffing compound 32. In addition, it is believed that heating rod 12 to the 160° F. temperature causes any microcracks in the periphery of rod 12 to open up, facilitating impregnating them with buffing compound 32. Of course, as rod 12 cools, such microcracks then tend to close up, capturing the impregnating compound.

In order to facilitate operation in a commercial environment, computer controller 44 may be programmed by conventional programming methods to regulate the amount of power to induction coil 40 for achieving the desired temperature of rod 12, in response to operator input of one or more factors, such as the speed of movement, composition of the chrome plated materials and size of the chrome plated material being processed, such as the diameter of a rod.

After rod 12 has had buffing compound 32 applied, and after rod 12 is heated to a temperature above the melting point of buffing compound 32, which may occur in the sequence illustrated in FIG. 1, or in the reverse sequence (not shown), the heated rod and buffing compound are subjected to buffing. Thus, within the station of line 14, between housing sections 20 and 22, a rotating buffing wheel 34 engages rod 12 in a conventional manner. One or more additional subsequent buffing steps may also be used, such as at the station between housing sections 22 and 24 where rotating buffing wheel 36 buffs the heated rod and buffing compound, as well as possibly at the station illustrated between housing sections 24 and 26, where rotating buffing wheel 38 buffs rod 12 and buffing compound 32 may be employed. The present invention does, however, allow for reducing the degree of surface finish, if desired, while still obtaining a significant improvement in the corrosion resistance of the chrome plated material. In addition, buffing compounds having a wider range of melting points, which may be desirable in particular hydraulic applications, may be readily accommodated by varying the computer controlled heater input.

As will be apparent from the foregoing description, and the illustration of FIG. 1, the present invention provides an apparatus for practicing a method for improving corrosion resistance of chrome plated material. Thus, chrome plated material, such as rod 12, is subjected to the steps of applying a buffing compound 32, either as a solid, or a liquid using sprayer 30, heating rod 12 to a temperature of approximately 160° F., a temperature above the melting point of buffing compound 32, and then subjecting the heated rod and applied buffing compound to at least one buffing wheel, before the rod cools down significantly. Thus, if rod 12 is heated to 160° F., the buffing is accomplished while the rod is at approximately 140° F. Generally, an acceptable standard of corrosion resistance using the prior art process was forty-eight hours in an ASTM B117 salt spray test. With the apparatus and method described above, ASTM B117 salt spray test results of seventy-two hours, and longer, have been routinely obtained.

The foregoing description and drawings merely explain and illustrate the invention and the invention is not limited thereto except insofar as the appended claims are so limited, as those skilled in the art who have the disclosure before them will be able to make modifications or variations therein without departing from the scope of the invention.

What is claimed is:

1. A method for improving the corrosion resistance of chrome plated materials comprising the steps of:

applying a non-thermosetting buffing compound to the chrome plated materials, without requiring prior heat treatment of the chrome plated materials;

heating the chrome plated materials after applying the buffing compound;

buffing the heated chrome plated materials after the buffing compound has been both applied and heated.

2. The method according to claim 1 in which the buffing compound has a melting point, and the chrome plated materials and the buffing compound are heated above the melting point of the buffing compound.

3. The method according to claim 1 in which the chrome plated materials are heated to approximately 160° F.

4. The method according to claim 3 in which the buffing occurs before the chrome plated materials cool down below approximately 140° F.

5. The method according to claim 1 in which the heating step is done by an induction coil.

6. The method according to claim 1 in which the heating of the chrome plated material includes the step of controlling the heating by a computer responsive to input of one or more factors from the size, speed of movement and composition of the chrome plated materials.

7. The method according to claim 1 in which the buffing step is accomplished by at least one rotating buffing wheel.

8. The method according to claim 1 in which the buffing step is accomplished by a plurality of buffing wheels.

9. The method according to claim 1 including a step of advancing the chrome plated materials along at least a portion of a processing line extending from one entrance end to an opposed exit end, with the steps of applying the buffing compound, heating the chrome plated materials and buffing the heated chrome plated material with the buffing compound being applied at discrete intervals along the line from said one entrance end to said opposed exit end.

10. A method for improving the corrosion resistance of chrome plated materials comprising the steps of:

applying a non-thermosetting buffing compound to the chrome plated materials by spraying it onto the chrome plated materials;

heating the chrome plated materials after the step of applying the buffing compound; and buffing the heated chrome plated materials after the buffing compound has been applied and heated.

* * * * *